United States Patent [19]

Gach

[11] Patent Number: 4,603,785

[45] Date of Patent: Aug. 5, 1986

[54] TAMPER INDICATING CLOSURE

[75] Inventor: Peter P. Gach, Evansville, Ind.

[73] Assignee: Sunbeam Plastics Corp., Evansville, Ind.

[21] Appl. No.: 673,013

[22] Filed: Nov. 19, 1984

[51] Int. Cl.[3] ..... B65D 55/02

[52] U.S. Cl. ..... 215/230

[58] Field of Search ..... 215/230, 365, 203

[56] References Cited

U.S. PATENT DOCUMENTS 4,446,979 5/1984 Gach et al. ..... 215/203

4,480,760 11/1984 Schonberger ..... 215/230

*Primary Examiner*—Donald F. Norton

*Attorney, Agent, or Firm*—Irvin L. Groh

[57] ABSTRACT

A tamper indicating closure including a transparent outer cap and an inner insert disc with an integral depending plug seal which relies on the relative movement of the outer cap and the inner disc during opening movement to indicate tampering of the container after it has been sealed for the first time. The relative movement is insured by the fact that the plug seal coacts with the container to resist rotation of the insert disc maintaining the container in a sealed condition while the outer cap is being rotated in an opening direction. The inside top surface of the clear outer cap is printed with a message such as "OK" or "SECURE" in an ink which is removable by a wiping action. The upper surface of the disc has ridges or wipers which remove all or part of the message upon initial opening. During the initial application of the closure to the container, friction between the plug seal and the container keeps the outer cap and insert disc together through cooperating drive lugs as the closure is screwed onto the bottle so that the message is undisturbed.

9 Claims, 6 Drawing Figures

TAMPER INDICATING CLOSURE

This invention relates to closures for containers and more particularly to closures of the type which indicate tampering. There are a large variety of closures for container which attempt to give evidence that the container has been opened, or at least been placed in condition for opening once it has been filled. The purpose of such closures is to insure that consumers can be confident that a closure has remained in the closed position once it has been filled, and not opened prior to its purchase. It is the general object of this invention to provide a tamper indicating closure which does not require a special container and therefore can be used with a wide variety of containers of standard configuration.

Another object of the invention is to provide a tamper indicating closure which has a worded message indicating that the closure has not been tampered or opened.

It is still another object of the invention to provide a tamper indicating closure of simple two-part construction which provides for easy manufacture and assembly.

It is still another object of this invention to provide a closure which may be used with or without a tamper indicating indicia which indicia is easily applied prior to assembly of the closure without modification of the closure parts.

The objects of the invention are accomplished by a tamper indicating closure having a cap portion for threaded engagement with the threaded neck of a container and having a disc insert member which frictionally engages the neck of the container and is preferably also capable of sealing the closure. The cup shaped cap member is made from clear plastic material to which an indicia or message is applied on the inside of the top of the cap member in a manner clearly visible through the cap. This message indicates that the container has not been tampered with or previously opened. A wiper is formed or attached to the top of the disc insert member which is placed in contact with the inside of the top of the cap member in a manner that relative motion of the cap and insert disc will remove or distort the message indicating to the observer that the closure has been tampered with. Alternatively the message can be applied to the upper surface of the disc member and the wiper formed or attached to the inside top of the cap. The top of the disc insert member is retained in a groove in the cap by a retaining bead which permits relative rotation of the insert disc relative to the cap member. The disc member has a friction generating appendage preferably in the form of an annular plug seal depending from it with a radially outward facing cylindrical friction surface for engagement with a complementary surface on the inner wall of the opening in the neck of the container. The closure provides for cooperating drive means on the cap member and the insert member in the form of three equally spaced drive posts located on the inner circumference of the cap which is engagable with an equal number of spaced lugs extending radially outward from the periphery of the disc member. In operation, when the container has been filled, the closure is screwed onto the container in a clockwise direction, the cap and insert member move as a unit through the coaction of the drive posts and lugs being in engagement. As the cap is turned, the annular plug seal is moved axially into a seated position relative to the neck of the container. During this closing operation, the indicia or message remains undisturbed. Upon rotational movement of the closure member in an opening, counter-clockwise direction, the cap will move relative to the insert member because the plug seal will remain seated, and the wipers will move across the message removing or partially removing it indicating that an initial opening or tampering of the closure has been made.

The presently preferred embodiments are illustrated in the accompanying drawings in which.

Figure 1:
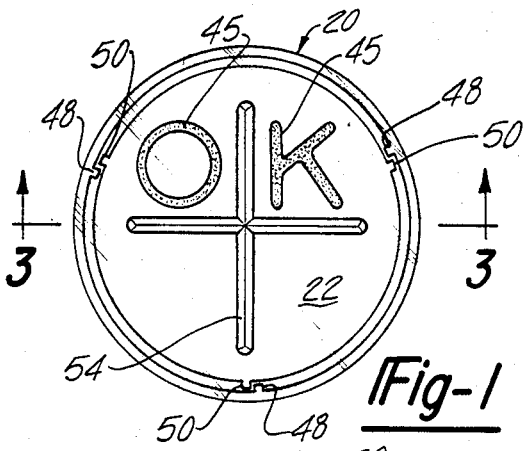
FIG. 1 is a top view of the closure embodying the invention showing the closure in its initially closed position relative to the container.

A tamper indicating closure embodying the invention id designated generally at 10 and is adapted for use with containers 12 having a neck 14 forming an opening 16 through which the contents can be introduced and dispensed from the container. The exterior of the neck 14 has external threads 18 adapted to receive complementary threads on the closure 10.

The closure 10 includes a cup-shaped cap 20 with a generally flat top 22 and a depending annular skirt 24. The skirt 24 is provided with internal threads 26 complementary to the threads 18 on the exterior of the neck of the container 12. The closure 10 also includes a disc insert 28 supported for rotation within the cup-shaped cap 20. The disc insert member 28 is provided with a top 30 and a depending plug seal 32 having an annular flange 34 with an outer, annular cylindrical friction ring or surface 36 which seats in engagement with the inner wall 38 of opening 16 in the neck 14 of the container 12. A cam surface 40 is provided below the friction surface 36 to act as a guide for introduction of the plug seal into the opening 16 in the neck 14 of the container 12.

The disc insert member 28 is held in groove 42 of cap 20 by retaining bead 44 which is snapped into place when the insert disc member 28 is assembled to the cap 20. An alternative method of supporting the disc member 28 in cap 20 would be by means of a post formed integrally with the cap 20 which would project through an axially aligned opening in the disc member as shown and described in my U.S. Pat. No. 4,446,979. The cap 20 is made from a clear plastic material so that a message or indicia 45 printed on the inside of top surface 22 will be clearly visible. It will be appreciated that when the term "clear" or "transparent" is used in the description or claims the intention is to convey the fact that the message is clearly visible or discernible through the cap, so that the term would embrace even a translucent material for this purpose. Both the cap 20 and the insert member 28 can be molded of similar or different plastic materials. For example, the cap can be made from polypropylene to enhance thread engagement, whereas the insert member may be made from a high density polyethylene. Also the insert member may be colored and opaque to highlight the message printed on the clear cap. Likewise, as long as the message is visible through the clear cap, the message 45 can be printed on top 30 of insert 28.

The cap 20 and the disc insert 28 have cooperating drive means 46 which include a drive post 48 which is formed integrally with cap member 20 extending downwardly from top 22 into groove 42. Drive lug 50 extends radially outward from the top 30 of disc member 28 into groove 42 for driving contact with drive post 48. Preferably three equally spaced posts 48 and lugs 50 are provided.

Figure 5:
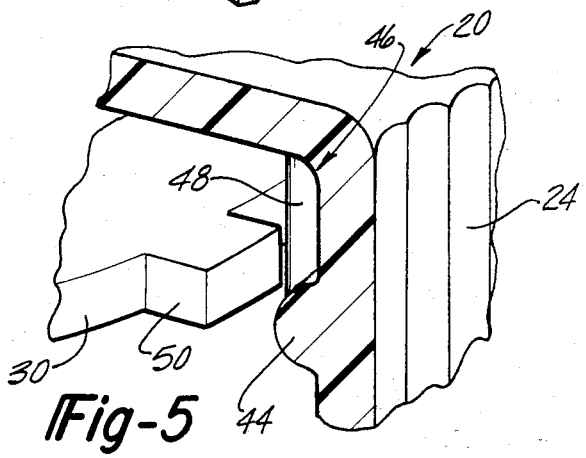
FIG. 5 is an enlarged perspective view showing the details of the drive means.

As seen in FIGS. 1 and 5, drive posts 48 are in contact with drive lugs 50 so that clockwise rotation of cap 20 is effective to move cap 20 and insert member 28 as a unit to bring complementary threads 18 and 26 into engagement with each other to move said closure 10 in a closing direction. Such movement causes the closure 10 to move axially relative to the container 12 so that the cam surface 40 enters the opening 16 in the neck 14 and continuing clockwise rotation causes the cylindrical friction surface 36 to be moved axially into seated engagement with the internal surface 38 of opening 16. Such axial movement is transmitted from the cap 20 to disc member 28.

Opening of closure 10 is obtained by counterclockwise rotation of cap 20. Starting with the tightened or sealed position of the closure 10 on the container 12 as shown in FIGS. 1 and 5 wherein the drive posts 48 of the cap 20 are in contact with the lugs 50 on insert member 28, the insert member 28 will remain stationary as its depending plug seal 32 is seated in opening 16, and the rotation of cap 20 will move drive posts 48 out of contact with lugs 50. During this initial counter-clockwise movement of cap 20, the plug will start to move vertically upward from opening 16, the axial movement being transmitted from the cap 20 to disc member 28 through retaining bead 44. When cap 20 has been rotated approximately 120 degrees, drive posts 48 will come into contact with the other sides of lugs 50 causing the cap and insert disc members to move as a unit until the closure is opened and can be removed from container 12.

Wiper means 52 is applied to the upper side of top 30 of disc insert member 28 which preferably takes the form of four equally spaced radially extending ridges 54 formed integrally with top 30. As the disc insert member 28 is assembled to cap 20 with bead 44, wipers or ridges 54 are held in contact with top 22.

Figure 2:
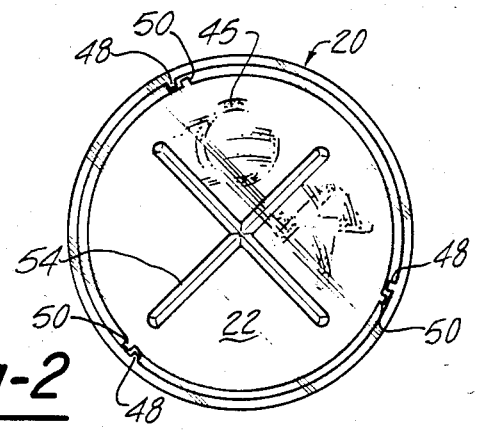
FIG. 2 is a top view similar to FIG. 1 except that the printed message has been partially removed indicating the closure has been opened.
Figure 3:
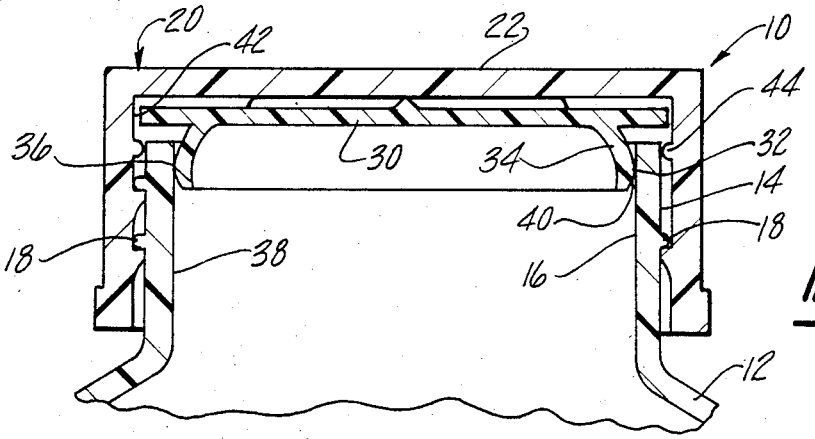
FIG. 3 is an elevational view in cross-section taken along line 3—3 of FIG. 1.
Figure 4:
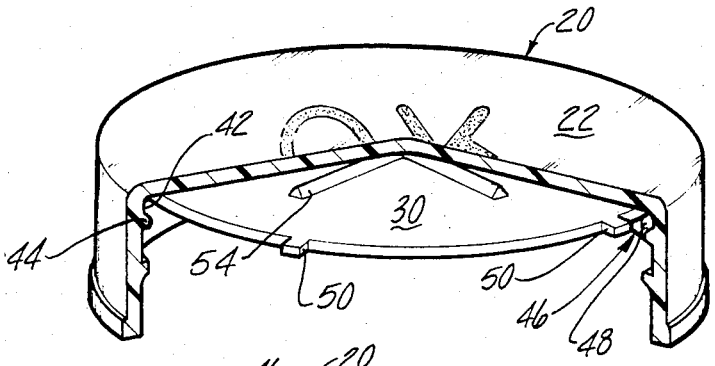
FIG. 4 is a perspective view of the closure with a portion of the cap broken away.

A word message or other indicia 45 is printed or otherwise applied to the inside of top 22 of cap 20. The message seen through the clear cap indicates to the observer that the closure is in its original packaged and sealed condition. The indicia 45 may be a word or words, abbreviation or a symbol. As shown in FIGS. 1, 2 and 4 "OK" has been used. Another such word message could be "SECURED". Indicia 45 is printed or otherwise applied to top 20 with material and in a manner that it is removable by the wiping action of wiper means. 52. As explained above, during the initial closure and sealing of the filled container 12 by closure 10, the insert disc member 28 does not move relative to cap 28, thus the wipers 52 do not disturb the message 45. However, upon opening of the closure, the cap 20 will move relative to the disc insert member. With the use of three equally spaced drive posts 48 and drive lugs 50, the relative rotation would be approximately 120 degrees. The four wipers equally spaced at 90 degrees apart would pass in wiping contact with the entire message 45 removing or partially removing and distorting the message so that the observer would be aware that the container had been tampered with or had initially opened. In the subsequent opening and closing of the closure 10, the parts function in the same way, not being effected by the initial opening or tamper indicating function. If the message is applied to the top 30 of the insert 28, the wipers 54 would be formed on the inside of the top surface 22 of cap 20 for the same coaction as recited above.

Figure 6:
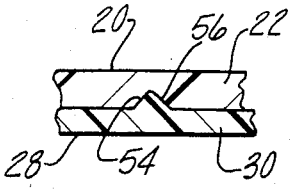
FIG. 6 is a fragmentary cross-sectional view showing a modification to the wiper.

FIG. 6 shows the modification in which the ridges or wipers 54 are formed integral with the insert member top 30 in the same manner, but additionally complementary grooves 56 are formed in top 22 of cap 20 to receive ridges 54 to create a preload, further assuring a complete wiping action. If the wipers 54 are formed on top 22 of cap 20, the complementary grooves would be formed on the insert member top 30.

Insert disc member 28 has been described as having a depending plug seal 32 with an annular flange 34; the flange 34 having an outer, annular cylindrical friction ring or surface 36 which seats in engagement with the inner wall 38 of opening 16 in neck 14 of container 12 to provide the frictional resistance necessary to allow cap 20 to turn relative top insert 28 for tamper indication. The insert 28 could have other equivalent means to generate the necessary friction such as a ratchet or even a temporary adhesive, which can be broadly termed a friction generating surface.

The embodiments of the invention in which an exclusive property or privilege is claimed are defined as follows:

1. A tamper indicating closure for a container having a threaded neck forming an opening comprising, in combination: a cup shaped cap.member made from clear plastic material having internal threads to engage with threads on the neck of said container; a disc member having a friction generating means for engagement with said neck; cooperating drive means including a drive post on said cap member engagable with a lug on said disc member, indicia applied to the first one of the inside of the top of said cap member or the top of said disc member in a manner to be clearly visible through said cap member, and radially extending wiper means on the other of the inside of the top of said cap member or the top of said disc member in contact with the first one of the inside of the top of said cap member or the top of said disc member, whereby upon initial rotational movement of said closure in a closing direction, said cap and said insert members move as a unit, the cooperating drive post and lug being in engagement, and said friction generating means engages the neck of said container, said indicia remaining undisturbed, and upon rotational movement of said closure member in an opening direction said cap member will move relative to said disc member, and said wiper moves across said indicia and said indicia is distorted or partially removed by said wiper passing over thereover, indicating an initial opening of the closure has been made.

2. The tamper indicating closure of claim 1 wherein said friction generating means includes an annular plug seal depending from said disc member, said plug seal having a radially outward facing cylindrical friction surface for engagement with a complementary surface on the inner wall of said opening in said neck and upon initial rotational movement of said closure in a closing direction, said plug seal is moved coaxially to a seated position relative to the neck of said container and upon rotational movement of said closure member in an opening direction said annular plug seal will remain seated.

3. The tamper indicating closure of claim 2 wherein said indicia is applied to the inside of the top of said cap member and said wiper means is formed on the top of said disc member.

4. A tamper indicating closure for a container having a threaded neck forming an opening comprising, in combination: a cup shaped cap member made from clear plastic material having internal threads to engage with threads on the neck of said container, a disc member having an annular plug seal depending therefrom with a radially outward facing cylindrical friction surface for engagement with a complementary surface on the inner wall of said opening in said neck, cooperating drive means including a drive post on said cap member engagable with a lug on said disc member, indicia applied to the inside of the top of said cap member in a manner to be clearly visible through said cap member, and radially extending wiper means on the top of said disc member in contact with the inside of the top of said cap member, whereby upon initial rotational movement of said closure in a closing direction, said cap and said insert members move as a unit, the cooperating drive post and lug being in engagement, and said annular plug seal is moved axially to a seated position relative to the neck of said container, said indicia remaining undisturbed, and upon rotational movement of said closure member in an opening direction said cap member will move relative to said annular plug seal which plug seal remains seated, and said wiper moves across said indicia and said indicia is distorted or partially removed by said wiper passing over thereover, indicating an initial opening of the closure has been made.

5. The tamper indicating closure of claim 4 wherein said disc insert member is supported by said cap member in a groove formed between an annular retaining bead and the inside of the top of said cap member.

6. The tamper indicating closure of claim 4 wherein said cooperating drive means includes a plurality of equally spaced drive posts located on the inner circumference of said cap engagable with an equal number of equally spaced lugs extending radially outward from the periphery of said disc member.

7. The tamper indicating closure of claim 6 wherein said cooperating drive means includes three equally spaced drive posts and three equally spaced lugs.

8. The tamper indicating closure of claim 4 wherein when said wiper means comprises four equally spaced radially extended ridges integrally formed on the top of said disc insert member.

9. The tamper indicating closure of claim 8 and further comprising four equally spaced radially extending grooves integrally formed in the inside of the top of said cap member, said grooves receiving said ridges to provide a preload on the wiper means against the disc insert member to aid in the destruction of said indicia upon the initial rotational movement of said closure member in an opening direction.

* * * * *